United States Patent [19]

Bayerlein et al.

[11] Patent Number: 5,056,430

[45] Date of Patent: Oct. 15, 1991

[54] METHOD OF POSITIONING PLATE CYLINDERS IN A MULTI-COLOR ROTARY PRINTING MACHINE

[75] Inventors: Friedrich K. Bayerlein, Veitshöchheim; Dietrich R. K. Leuerer, Wüzburg, both of Fed. Rep. of Germany

[73] Assignee: Koening & Bauer Aktingesellschaft, Wurzburg, Fed. Rep. of Germany

[21] Appl. No.: 415,309

[22] PCT Filed: Mar. 25, 1988

[86] PCT No.: PCT/DE88/00192

§ 371 Date: Sep. 15, 1989

§ 102(e) Date: Sep. 15, 1989

[87] PCT Pub. No.: WO88/07449

PCT Pub. Date: Oct. 6, 1988

[30] Foreign Application Priority Data

Mar. 26, 1987 [DE] Fed. Rep. of Germany ..... 3709951
Mar. 24, 1988 [DE] Fed. Rep. of Germany ..... 3809941

[51] Int. Cl.[5] ..... B41M 1/14
[52] U.S. Cl. ..... 101/211; 101/181
[58] Field of Search ..... 101/181, 211, DIG. 36; 33/16, 17, 20, 21; 226/2, 28

[56] References Cited

U.S. PATENT DOCUMENTS 3,015,266 1/1962 Anderson et al. ..... 101/181
4,273,045 1/1981 Crowley ..... 101/211
4,534,288 8/1985 Brouman ..... 101/181
4,932,320 6/1990 Brunetti et al. ..... 101/181

FOREIGN PATENT DOCUMENTS 118467 8/1970 Denmark ..... 101/181
2455973 6/1975 Fed. Rep. of Germany .
3138699 4/1983 Fed. Rep. of Germany .
0259446 12/1985 Japan ..... 101/DIG. 36
1220485 1/1971 United Kingdom ..... 101/181

OTHER PUBLICATIONS

"Application of TV-picture for measuring tasks of the printing technology"—Technical Speeches 1971—publication by the German Research Company for Printing and Reproduction Technology.

*Primary Examiner*—Edgar S. Burr
*Assistant Examiner*—Ren Yan
*Attorney, Agent, or Firm*—Jones, Tullar & Cooper

[57] ABSTRACT

A method for ascertaining possible register errors and for correcting the positioning of printing plate cylinders in a multi-color rotary printing machine utilizes geometric and regular figures of different sizes as register marks images. These figures, such as circles or squares are printed into each other and the resulting register marks' prints may be analyzed to provide infotmaion useable to correct register errors in both the X and Y distances.

3 Claims, 2 Drawing Sheets

METHOD OF POSITIONING PLATE CYLINDERS IN A MULTI-COLOR ROTARY PRINTING MACHINE

FIELD OF THE INVENTION

The present invention is directed generally to a method of positioning printing plate cylinders in a multi-color rotary printing machine. More particularly, the present invention is directed to a method for positioning plate cylinders in a multicolor rotary printing machine by using register marks. Most specifically, the present invention is directed to a method for positioning plate cylinders in a multi-color rotary printing machine using register marks on each plate cylinder with these register marks being arranged to form regular geometric figures as register marks prints on the print carrier. These regular geometric figures may be concentric circles or squares and facilitate the measurement of the distances between adjacent register marks so that these distances may be analyzed by suitable electric image detecting devices. Once the positions of the register marks prints have been measured and analyzed, the printing plates can be adjusted, if necessary, to correct register errors.

DESCRIPTION OF THE PRIOR ART

It has become generally known in the art to utilize various television cameras and associated video devices to evaluate printed products. The publication "Technische Vortrage 1971" or Technical Speeches 1971, published by the Deutsche Forschungsgesellschaft fur Druck-und Reproductionstechnik e.v., or the German Research Company for Printing and Reproduction Technology provided an essay entitled "Application of TV-Picture Evaluation for Measuring Tasks of the Printing Technology". This essay discussed the use of a video signal from a TV camera to evaluate printed products. It is further generally known in the art to optically enlarge various video pictures so that a picture element to be evaluated will be cut by a sufficient number of TV-lines.

In the German published unexamined patent application No. 31 38 689 there is disclosed a device for the detection of picture copies by using a video camera as the detection device. In this application, the camera is a vidicon or so-called CCD-camera and may be equipped with a zoom objective lens. In another German published unexamined patent application No. 24 55 973 there is described an optical character searching device in which the video signal may be digitized.

In PCT Application No. WO 86/05141 there is disclosed a process and a device for the execution of the process which is useable with a multi-color rotary printing machine to position the various plate cylinders of the printing machine with respect to each other. This is accomplished by utilizing deviations of one register mark with respect to each other. This is accomplished by using a video camera to record a group of marks printed on the print carrier and to form an image of this group of marks. This image is then converted into a numerical image which may be compared with an "analysis window". The "analysis window" consists of a reference point to which is associated a mark on the printing carrier.

A disadvantage of the above-discussed process is that the ink register marks are provided as points with a diameter of approximately 1 mm with these points being arranged as corner points of an imaginary square having an edge length of approximately 10 mm. This type of register points are difficult to detect electronically. Defects on the printing carrier itself in the area adjacent or within the square of register marks could erroneously be analyzed as register point by the electronic system. Additionally, for point-shaped register marks, a leading, additional, bar-shaped trigger register mark is required. Furthermore, the position of each point to each other point must be calculated in both the X- and Y- directions. If the electronic system fails, it is quite difficult for the printer to visually recognize the register deviation of the marks as they can be separated from each other by a distance of up to 10 mm and more. Due to the large distance between the color register marks, it is impossible to measure the distances between the marks by using a measuring microscope. As the color register points are located on different levels from each other, the different distances have to be calculated first for the display on the screen. Moreover, in the process disclosed in this prior art material, the whole "analysis window" must be analyzed. That means that a computer with a large capacity is required if one wants to keep the analysis time short. Alternatively, one may use a smaller computer and accept a longer analysis time Because of this relatively long analysis time, the application of this process is not overly appropriate for fast-running rotary web-fed printing machines which may have a web speed of 15 m/sec or more.

While the prior art discloses the general concept of using various marks and video cameras to measure the registry of printing plates in a multi-color press assembly, these prior art processes have required significant computer capabilities, substantial time, and have been difficult to use in the absence of electronic signal processing equipment. Thus there is a need for a more practical and easily useable process. The method for positioning printing plate cylinders in a multi-color rotary printing machine in accordance with the present invention provides such a process and is a significant advance in the art.

SUMMARY OF THE INVENTION

It is an object of the present invention to provide a method of positioning plate cylinders in a multi-color rotary printing machine.

Another object of the present invention is to provide a method of measuring ink registry in both longitudinal and side register on multi-color rotary printing machines.

A further object of the present invention is to provide a method of measuring ink registry on multi-color rotary printing machines using an ink video camera.

Still another object of the present invention is to provide a method for measuring ink registry in multi-color rotary printing machines and to determine deviations from a set value.

Yet a further object of the present invention is to provide a method for measuring ink registry in multi-color rotary printing machines without the necessity of having to evaluate the total measuring window.

As will be discussed in greater detail in the description of the preferred embodiment which is set forth subsequently, the method of measuring registry and positioning plate cylinders in a multi-color rotary printing machine in accordance with the present invention utilizes a plurality of register marks, each of which is printed, as a register mark print, onto the print carrier by successive ones of the individual printing plates in the printing machine. These register marks prints form one of several regular geometric figures which have thin boundary lines and which, in the preferred configuration, provide either concentric circles or rectangles. These geometric configurations can be analyzed using electric image detecting devices, such as video cameras, and the distance between individual ones of the thin lines can be reviewed to provide an indication of the registry between individual printing plates. It is not necessary to evaluate the complete array of register marks to obtain appropriate information regarding plate registration errors. One of the primary advantages to be achieved by the present invention is that the deviation of the register marks to each other can directly be measured both in the X- as well as in the Y- directions. Thus this deviation need not be calculated especially by means of computers. The register marks in accordance with the invention are designed as regular, geometric figures, so that it is possible to check by means of software that only register marks and not possible defects on the printing carrier itself are analyzed. It is also easily possible for the press operator to visually check the position of the register marks to each other on a screen. To accomplish this, it is only necessary for the operator to insert a scale in the X- and Y-directions into the image on the screen. It is also unnecessary to analyze the whole "analysis window". As a rule, only the immediate surrounding field around the center of the "analysis window" need be analyzed. Only in extreme cases must the whole "analysis window" be read digit for digit and analyzed.

By using the method of the present invention, the decision and the introduction of adjusting procedures are made faster than was the situation when using prior art methods, provided the same computer capacity. The method of positioning printing plate cylinders in a multi-color rotary printing machine in accordance with the present invention will thus be seen as providing superior registry determination in less time and with less difficulty than was required by prior methods. As such the present method provides a substantial improvement over the prior art.

BRIEF DESCRIPTION OF THE DRAWINGS

While the novel feature of the method of positioning plate cylinders in a multi-color rotary printing machine in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

As was set forth in the Description of the Prior Art portion of the present application, the PCT patent application WO 86/05141 discloses and describes how color register marks for a multi-color print on a print carrier, such as for example a paper web, may be printed out then detected for analysis by a video camera. The analysis may be conducted by a suitable computer, again as discussed in this prior art patent. Furthermore, the positioning of the register marks on the print carrier is also discussed generally in this prior art. It will thus be understood that it is not necessary to discuss the overall multi-color printing process or the specific means to adjust plate cylinders in their longitudinal axis direction and around their longitudinal axis. These are acknowledged as prior art and do not form a part of the present invention.

Figure 1:
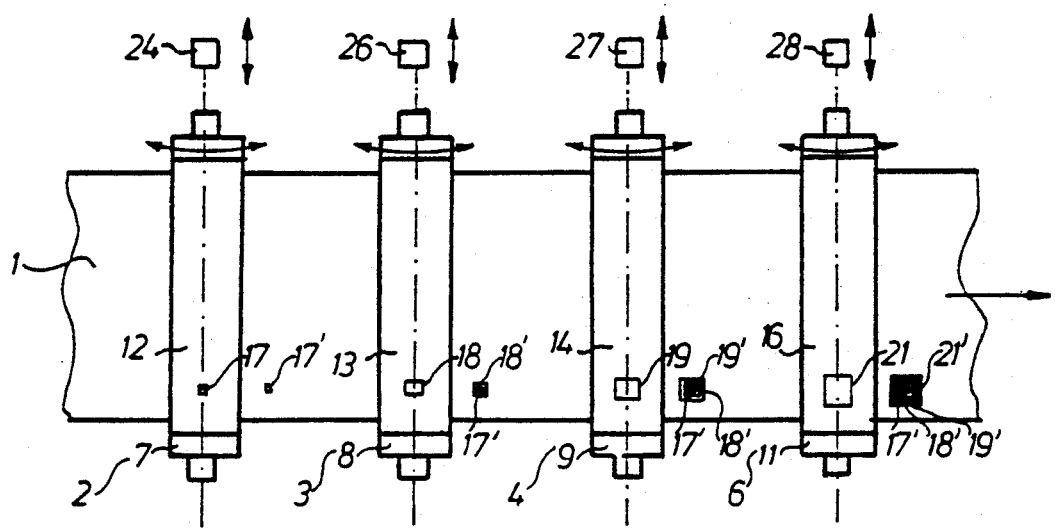
FIG. 1 is a top plan view of a schematically depicted four color rotary web-fed printing machine showing plate cylinders in accordance with the present invention.

Referring now initially to FIG. 1, there may be seen a printing carrier 1 which passes through four sequentially positioned printing units 2, 3, 4 and 6. Each of these printing units 2, 3, 4 and 6 consists, in a generally known manner, of an impression cylinder, a blanket cylinder, a plate cylinder and an inking unit. In this schematic drawing there are only depicted the four plate cylinders 7, 8, 9 and 11 with their associated printing plates 12, 13, 14 and 16, as seen in the print carrier running direction.

Each color to be printed by the multi-color printing machine has its own printing cylinder and associated printing plate. Furthermore, each printing plate has its own individual register mark associated with it. Thus, to accomplish four color printing of print carrier 1 there are required the four printing plates 12, 13, 14 and 16, as shown in FIG. 1. While the method in accordance with the present invention will hereinafter be discussed using a four color printing press, it will be apparent that printing presses using greater or fewer than four colors are also contemplated by the invention.

Figure 2:
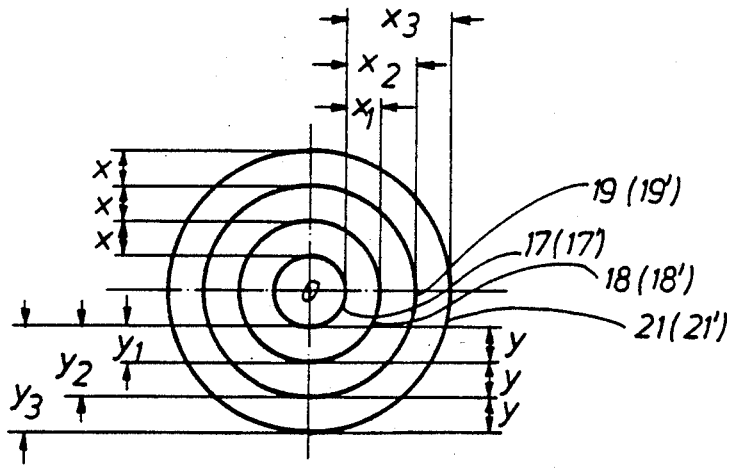
FIG. 2 is a depiction of a first configuration of a plurality of register marks printed onto a print carrier in accordance with the present invention.
Figure 3:
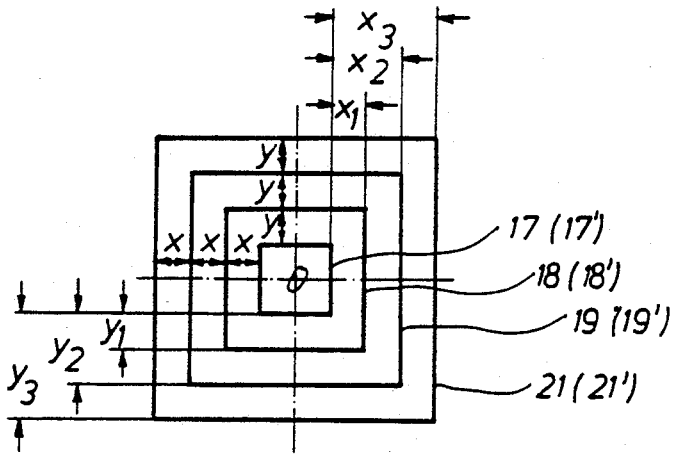
FIG. 3 is a depiction of a second configuration of a plurality of register marks.

Again referring to FIG. 1, each of the four printing plates 12, 13, 14, and 16 is provided with a register mark image 17, 18, 19 and 21 respectively and each applies, according to the corresponding coloring, in the order black-blue-red-yellow, prints 17', 18', 19' and 21' on the printing carrier 1, 17' is printed in black, 18' is printed in blue, 19' is printed in red and 21' in yellow. The register marks' images 17, 18, 19 and 21 and thus the register marks' prints 17', 18', 19' and 21' are designed as regular figures preferably as closed squares or circles. Their printed lines are approximately 0.01–0.05 mm wide. All four register marks' images 17, 18, 19 and 21 have different sizes from each other, so that their, for example, diameters are different from one the other, as may be seen in FIGS. 2 and 3. In practice, the dimensions of the register marks' images on their respective printing plates will be selected so that in the ideal situation in which there is no register errors, four register marks' images 17, 18, 19 and 21 will print concentrically into each other so that, as may be seen in FIGS. 2 and 3 the distances "X" and the distances "Y" between the concentrically placed and similarly shaped register marks' prints 17; 18', 19' and 21' will be spaced from each other by a distance of generally about 2.0 mm. If the several printing plates 12, 13, 14, and 16 are not in proper registry with each other the register marks' prints 17', 18', 19', and 21' will no longer be in concentric registry, as seen in FIGS. 2 and 3. In this situation, the distances "X" and "Y" will no longer be the same from one line to the next and this will provide a clear indication of a registration error.

Figure 4:
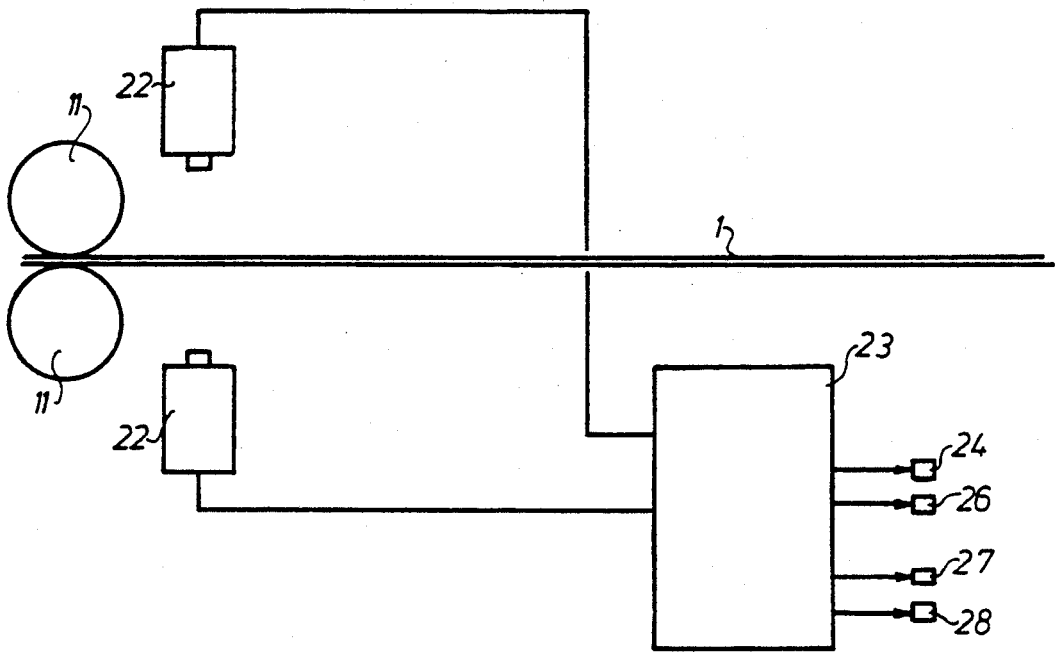
FIG. 4 is a schematic depiction of an overall measuring assembly in accordance with the present invention.

Turning now to FIG. 4, in conjunction with FIGS. 2 and 3, an image detecting device generally at 22 may be used to measure the deviations of the register marks' 17', 18', 19', and 21' to each other in their "X" and "Y" directory. This image detecting device 22 may be of the general type discussed in the prior German published unexamined patent application No. 31 88 699 and the PCT application WO 86/05141. The deviations measured, such as $X_1$, $X_2$, $X_3$, and $Y_1$, $Y_2$, $Y_3$ for a four-color printing are then fed, as real values, to a control system for the rotation of the plate cylinders 7, 8, 9 and 11 to each other in a circumferential direction to effect longitudinal register, and for the displacement in an axial direction. These real values are compared with setpoint values, such as once x, twice x, three times x, once y, twice y, three times y, out of which adjusting values are created. Adjusting devices 24, 26, 27, 28 on the plate cylinders 7, 8, 9 and 11 are then used so that the plate cylinders 7 to 11 are adjusted to each other in circumferential and/or longitudinal axis directions. These adjustments will thus correct the registration errors shown by the register marks' prints 17', 18', 19' and 21.

The corrections of the distances within one set 17', 18', 19' and 21' of register marks' prints may be electronically measured in both the "X" and "Y" directions and these distances may be referenced to the innermost register marks' print 17'. This will allow one to obtain the distances, $x_1$, $x_2$, $x_3$ of the register marks' prints 18', 19' and 21' from the innermost register marks' print 17' the x direction, as is seen in FIGS. 2 and 3. Similarly, the distances $y_1$, $y_2$, $y_3$, of the register marks' prints 18', 19' and 21' from the innermost register marks' print 17' in the Y direction may be obtained. These measurements may be continuously carried out for each printing multi-color printed image since, besides each multicolor printed image, there are also printed the four register marks' prints 17', 18', 19' and 21' which are in the form of boundary lines of circles or squares that have been printed into each other and which are of different sizes. These circles of squares thus only cut or contact themselves if there are longitudinal or side register faults.

Turning now primarily to FIG. 4, once the total register marks' prints 17' to 21' for one printed image of the multi-color prints, respectively, are printed in a provided area on the printing carrier 1, their positions in the X- and Y- coordinate system are continuously detected in the X- and Y- directions by a video camera 22 during the running of the printing carrier 1. The distances $x_1$, $x_2$, $x_3$ in the X- axis direction and $y_1$, $y_2$, $y_3$ in the Y- axis direction from the boundary of the smallest register marks' prints 18', 19', 21' are electronically measured. These values are continuously compared with setpoint values and each difference value is continuously converted into an adjusting value for each plate cylinder 7, 8, 9, and 11; and for each plate 12, 13, 14, 16 by means of a regulating device in order to rotate the individual plate cylinders 7, 8, 9, 11 in their longitudinal axis direction and/or in the circumferential direction in or against their rotary direction. Plate adjusting devices 24, 26, 27, 28 are known generally and form no part of the present application.

While a preferred embodiment of a method for positioning plate cylinders in a multi-color rotary printing machine in accordance with the present invention has been set forth fully and completely hereinabove, it will be apparent to one of skill in the art that a number of changes in, for example, the number of printing plates and plate cylinders used, the type of video camera and signal processing equipment, the type of plate shifting assemblies and the like may be made without departing from the true spirit and scope of the subject invention which is accordingly to be limited only by the following claims.

What is claimed is:

1. A method of positioning plate cylinders in a multiple color rotary printing machine usable for printing a multiple color image on a print carrier, said method comprising:

providing a first register mark image on a first plate cylinder of a first color printing unit;

forming said first register mark image as a closed regular geometric shape having thin lines and having a first size;

providing a second register mark image on a second plate cylinder of a second color printing unit;

forming said a second register mark image having said closed regular geometric shape having thin lines and having a second size, said second size of said second register mark image being different than said first size of said first register mark image;

providing a plurality of successive register mark images on successive plate cylinders of successive color printing units;

forming each of successive register mark images as said closed regular geometric shape of said first and second register mark images, each of said successive register mark images having thin lines and having a size which is different than said first and second sizes of said first and second register mark images and from sizes of other ones of said successive register mark images;

providing a separate one of said first, second, and successive register mark images for each color to be printed in a multiple color printing machine;

passing said print carrier through each of said first, second, and successive color printing units;

contacting each of said first, second, and successive closed regular geometric shaped, thin lined and different sized register mark images with said print carrier as said print carrier passes through said first, second, and successive color printing units;

printing first, second, and successive register mark prints on said print carrier corresponding to said first, second, and successive register mark images;

forming a plurality of similar concentric closed regular geometric figures on said print carrier, each of said concentric closed regular geometric figures having one of said first, second, and successive register mark prints;

detecting the position of each of said register mark prints in a selected one of said concentric closed regular geometric figures by using an image detecting device;

measuring relative distances between adjacent ones of said register mark prints in a selected one of said concentric closed regular geometric figures in X and Y axis directions;

converting said measured relative distances into adjusting values usable for adjusting relative positions of plate cylinders; and positioning one of said first, second, and successive plate cylinders using said adjusting values and obtaining proper color register of said first, second, and successive printing plates in said multiple color rotary printing machine.

2. The method of claim 1 including the step of providing said register mark prints in each of said closed regular geometric figures as squares of successively larger sizes.

3. The method of claim 1 including the step of providing said register mark prints in each of said closed regular geometric figures as circles of successively larger sizes.

* * * * *